US005181561A

United States Patent [19]

Ayers et al.

[11] Patent Number: 5,181,561

[45] Date of Patent: Jan. 26, 1993

[54] STIFFENER FOR USE WITH A HEAT EXCHANGER

[75] Inventors: Richard C. Ayers, Collinsville; Thomas G. Wilson, Owasso, both of Okla.

[73] Assignee: Lansing Overhaul And Repair, Inc., Tulsa, Okla.

[21] Appl. No.: 788,856

[22] Filed: Nov. 7, 1991

[51] Int. Cl.[5] ..... F28F 9/00

[52] U.S. Cl. ..... 165/162; 122/510; 165/906

[58] Field of Search ..... 165/82, 159, 162; 122/510

[56] References Cited

U.S. PATENT DOCUMENTS

| | | | |
|---|---|---|---|
| 1,856,618 | 5/1932 | Brown | 165/162 |
| 2,873,098 | 2/1959 | Morgan | 165/159 |
| 4,133,374 | 1/1979 | York | 165/82 |
| 4,305,453 | 12/1981 | Wagner | 165/69 |
| 4,434,846 | 3/1984 | Lu | 165/61 |
| 4,576,228 | 3/1986 | Glatthorn | 165/162 |
| 4,834,173 | 5/1989 | Weiss et al. | 165/159 |
| 5,020,587 | 6/1991 | Mongia et al. | 165/82 |

FOREIGN PATENT DOCUMENTS

| | | | |
|---|---|---|---|
| 2117503A | 10/1983 | United Kingdom | 165/162 |

*Primary Examiner*—Allen J. Flanigan
*Attorney, Agent, or Firm*—Head & Johnson

[57] ABSTRACT

For use in a heat exchanger having a plurality of tubes, a stiffener plate for supporting the tubes, the plate being in the form of a unitary relatively thin planar metal plate having an opening for each tube to be supported, each opening being in the form of an integral short-length tubular ferrule portion of internal diameter slightly greater than the external diameter of the tube to be received therethrough, each integral ferrule portion having an end surface that is in a plane paralleled to and spaced from the plate.

4 Claims, 4 Drawing Sheets

STIFFENER FOR USE WITH A HEAT EXCHANGER

BACKGROUND OF THE INVENTION

Heat exchangers are commonly employed apparatuses for exchanging heat from one medium to another, such as from one fluid to another fluid, from fluid to a gas or from a gas to a fluid. A common type of heat exchanger employs a plurality of lengths of parallel tubes through which one fluid circulates, the tubes being normally confined in an enclosure with provisions for flowage of fluid past the tubes and externally of them. In this way liquid passes concurrently through all of the tubes and the fluid with which heat is to be exchanged, such as air, passes externally of the tubes. Normally, a header is provided at each end of the paralleled tubes to connect the ends of the tubes to a common enclosure by which one fluid is conveyed to and from the heat exchanger.

Heat exchangers are frequently employed in the aircraft industry. The typical commercial passenger transport plane has many heat exchangers, such as for maintaining lubricant within a preselected temperature range, for heating and cooling the interior of the aircraft and so forth. While aircraft heat exchangers work in the same fundamental way as the heat exchangers for any other industrial or building application, aircraft heat exchangers are subjected to increased stress due to acceleration, such as when the aircraft is taking off or landing, and to a high degree of vibration. Acceleration and vibration are not typically a problem with most heat exchanger applications, such as heat exchangers used in residential or commercial air conditioning. For this reason, aircraft heat exchangers have posed special problems and additional attention must be paid in the design and manufacture of aircraft heat exchangers to combat the combined stress of acceleration and vibration.

In the typical heat exchanger that includes a multiplicity of spaced apart tubes, it is important that the tubes be supported with relationship to each other between the headers affixed to each end of the tubes. This is particularly true in aircraft heat exchangers since vibration and acceleration can cause movement of the tubes if not properly supported, resulting in failure of the heat exchanger. This disclosure is directed to an improved stiffener plate for use in heat exchangers, particularly of the type employed in the aircraft industry, although the invention is not limited to aircraft heat exchangers.

For reference to others who have provided heat exchanger designs applicable for aircraft industry and particularly for stiffener plates, reference may be had to the following previously issued U.S. Pats. Nos.: 2,488,627; 3,245,465; 4,054,355; 4,070,751; 4,131,332; 4,150,556; 4,191,040; 4,234,041; 4,381,135; 4,647,086; 4,634,208; 4,635,711; 4,653,779; 4,699,403; 4,890,867; 4,924,586; 4,940,263; and 4,958,757.

SUMMARY OF THE INVENTION

This invention provides an improved stiffener plate for use in a heat exchanger of the type employing a plurality of parallel tubes, the stiffener plate serving to support the tubes at locations intermediate the headers affixed to the opposed ends of the tubes in a way so as to reduce the effect of vibration and acceleration. The improved stiffener plate is in the form of a unitary relatively thin planar metal plate. The plate has an opening therethrough for each tube to be supported. Each opening is in the form of an integral short-length tubular ferrule portion of an internal diameter slightly greater than the external diameter of the tube to be received therethrough. Each integral ferrule portion has an end surface that is in a plane parallel to and spaced from the plate. The ferrules have an inner tubular surface defined in part by an arcuate portion of a selected first radius from the plate first surface and an outer tubular surface defined in part by an arcuate portion selected of a radius smaller than the first radius from the plate second surface. This arrangement provides a method of supporting heat exchanger tubes in a secure manner wherein areas of high stress concentration are not imposed on the heat exchanger tubes by the stiffener plate.

Further, the stiffener plate of this disclosure is substantially less time consuming to manufacture than other types of stiffener plates, particularly those which include a short-length tubular ferrule brazed to the plate for each opening therethrough.

A better understanding of the invention will be had by reference to the following description and claims, taken in conjunction with the attached drawings.

DESCRIPTION OF THE DRAWINGS

FIGS. 7, 8 and 9 are representative of the most commonly employed prior art type of stiffener plates as used in aircraft heat exchangers and to which the improved stiffener plate of this invention is an improvement.

DESCRIPTION OF THE PREFERRED EMBODIMENTS

Figure 1:
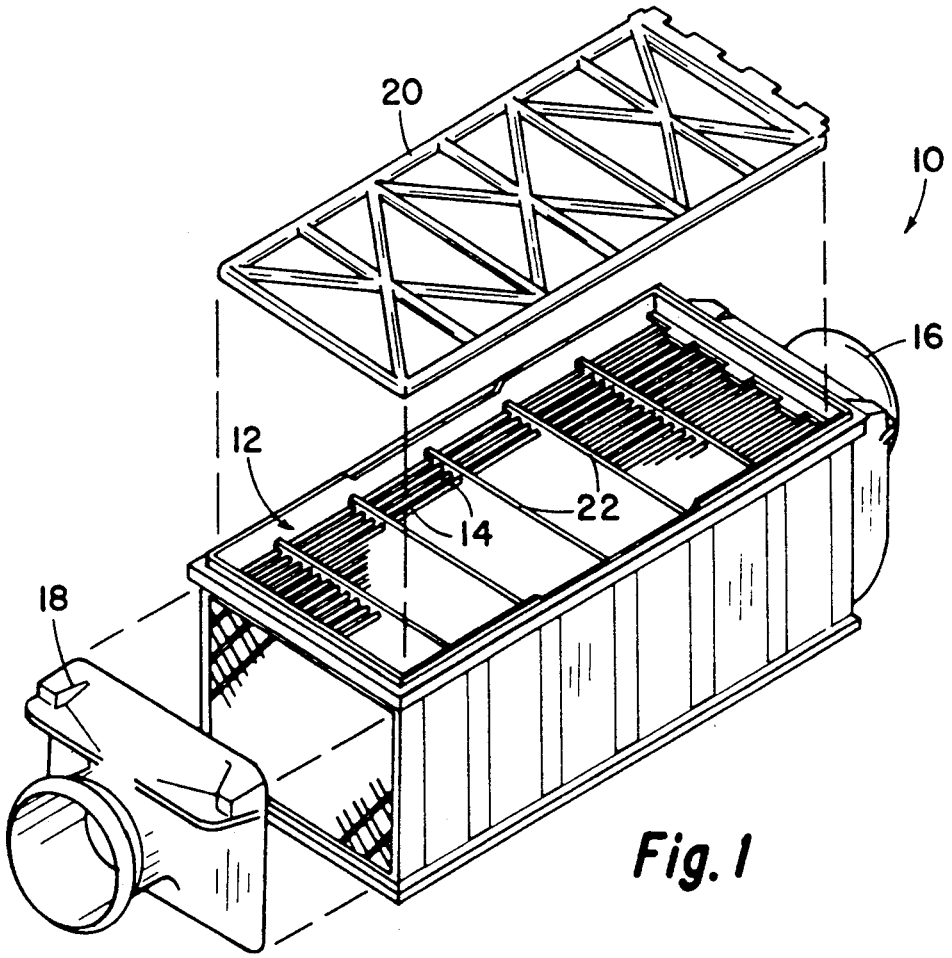
FIG. 1 is an isometric view of a typical aircraft type heat exchanger employing the improved stiffener plate of this disclosure.

Referring to the drawings and first to FIG. 1, a typical aircraft heat exchanger is illustrated in FIG. 1, the heat exchanger being indicated generally by the numeral 10. The heat exchanger includes a core, generally indicated by the numeral 12, that is, in effect, a bundle of tubes, the tubes being indicated by the numeral 14. The tubes are supported as a package and arranged for passage of fluids, such as a liquid or a gas, through the interior of the tubes. A first header 16 is affixed to heat exchanger 10 at one end which provides communication with one end of each of tube 14, and the second header 18 at the opposite end of the heat exchanger provides communication with the other end of the tubes. A support bracket 20 is used to add structural rigidity to the heat exchanger and provides for passage of a second fluid, such as gas which is typically air or exhaust gases, through the heat exchanger to exchange heat with the fluid passing within the interior of tubes 14.

It is to be emphasized that the apparatus described to this point is to form background for the invention that is the subject of this disclosure and heat exchanger 10 in FIG. 1 is merely illustrated as an example, as heat exchangers can take a great deal of different forms. In order to support tubes 14 within the heat exchanger core, it is usually necessary, unless the tubes are of very short length, to provide stiffener plates 22. The function of stiffener plates 22 is to structurally support tubes 14 in a manner to resist the forces of acceleration, vibration, and gravity and to maintain the tubes in their preselected spacing.

Figure 7:
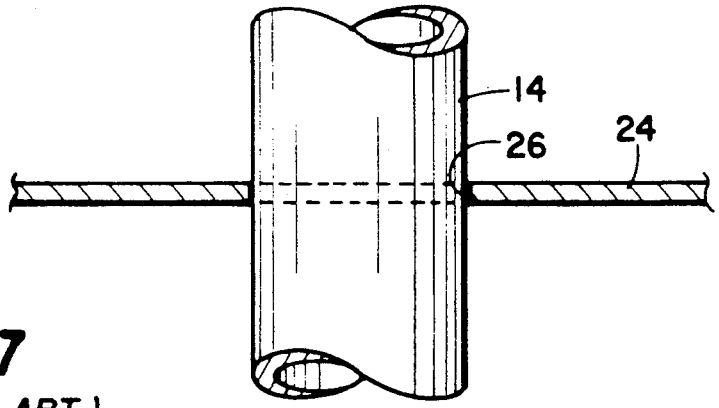
Fig. 7 (PRIOR ART)
FIG. 7 is a prior art illustration of one rudimentary type of stiffener plate as used in heat exchangers.

Heat exchangers of the type illustrated in FIG. 1 have long used stiffener plates of various embodiments. FIG. 7 is a diagrammatic view of a stiffener plate 24 having an opening 26 therethrough which receives a heat exchanger tube 14. In this arrangement, there is an opening 26 for each heat exchanger tube. The opening is of a diameter slightly greater than that of the exterior diameter of tube 14 so that tubes 14 may be inserted through the openings in the heat exchanger during assembly of the heat exchangers—that is, tubes 14 are not affixed to stiffener plate 24. It can be seen that opening 26 in plate 24 provides relatively sharp edges in an area of high stress concentration so that the possibility of the plate damaging or penetrating a tube 14 exists, particularly in aircraft applications wherein vibration is a constant problem.

Figure 8:
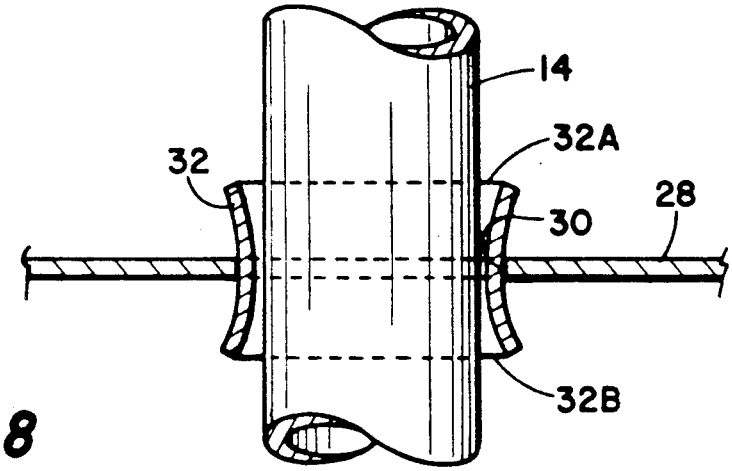
Fig. 8 (PRIOR ART)
FIG. 8 is a fragmentary view of a prior art stiffener plate of another configuration utilizing a type of ferrule that is secured through an opening through the stiffener plate by mechanical fastening, such as by expansion of the ferrule.

FIG. 8 is another example of the prior art arrangement for a stiffener plate 28 having an opening 30 for each of the heat exchanger tubes 14. In this arrangement a short-length tubular ferrule 32 is positioned within opening 30. In the commonly employed arrangement as illustrated, ferrule 32 is enlarged at ends 32A and 32B. Further, ferrule 32 is mechanically secured to stiffener plate 28 such as by expansion of the ferrule after it is positioned within opening 30. This expansion step attempts to mechanically secure the ferrule to plate 28 but the ferrule is not otherwise secured to the plate. This effort to mechanically attach a ferrule of the type shown in FIG. 8 has not been completely successful since heat exchangers, particularly as used in aircraft, are frequently subjected to widely varying temperatures, and the expansion and contraction of support plate 28 tends to destroy the mechanical bond between the plate and the ferrule.

The embodiment of FIG. 8 has substantial advantages over that of FIG. 7, but attempts to mechanically bond the ferrule to the plate have not been completely successful. Further, it can be seen that providing a stiffener plate with the large number of ferrules required wherein each ferrule must be internally expanded into mechanical engagement with the plate is extremely time consuming and expensive.

Figure 9:
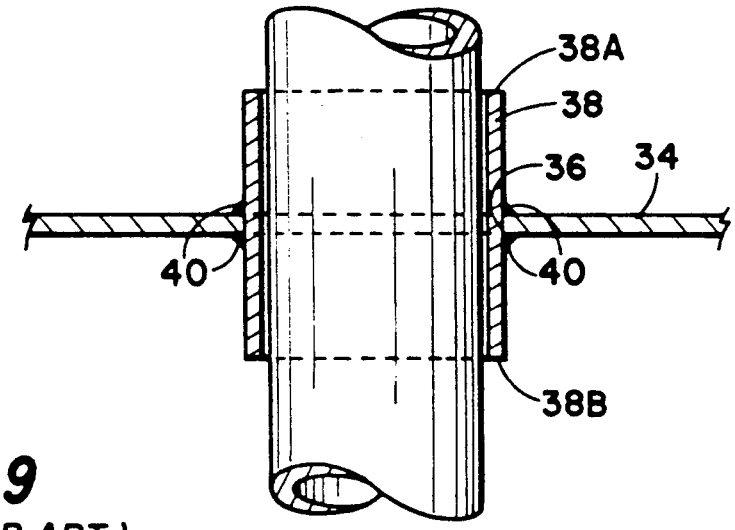
Fig. 9 (PRIOR ART)
FIG. 9 is a fragmentary view of a stiffener plate having a tubular ferrule brazed to an opening in the plate, the tubular ferrule serving to receive a heat exchanger tube therethrough.

Another type of stiffener plate is shown in the fragmentary view of FIG. 9 in which the stiffener plate 34 has opening 36 therein for each tube and each such opening 36 receives a short-length tubular ferrule 38. The ferrule 38 is attached to stiffener plate 34 by brazing at 40. The tubular ferrule 38 has opposed ends 38A and 38B that are in planes parallel to plate 34.

The arrangement of FIG. 9 is a distinct improvement over that of FIGS. 7 and 8. By the brazing 40 of FIG. 9, tubular ferrule 38 remains secured to the fastener plate 34, but brazing a ferrule in each opening is exceedingly time consuming and expensive. Further, the tubular ferrule 38 does not have the advantage of an arcuate internal surface, as does that of FIG. 8.

Figure 5:
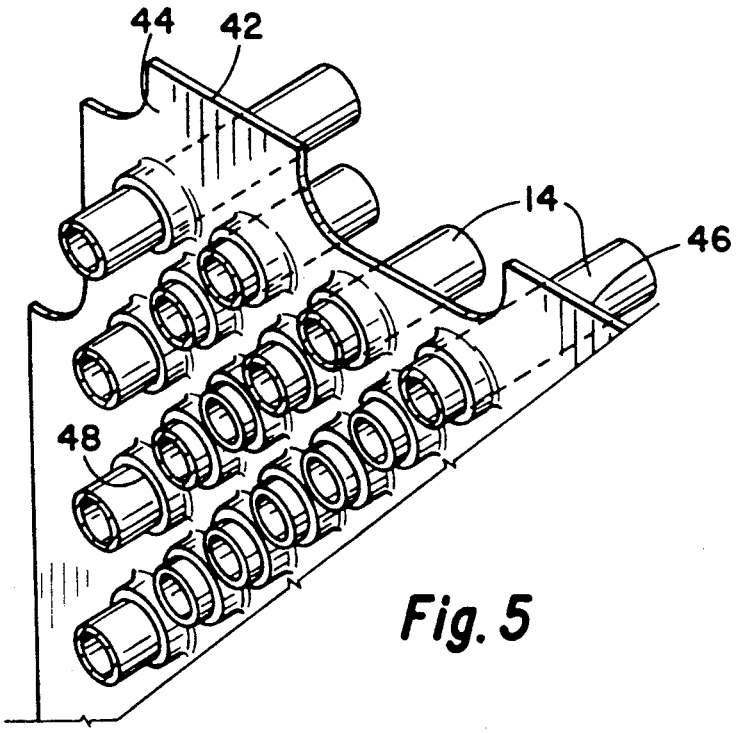
FIG. 5 is an isometric partial view of one portion of a stiffener plate of this disclosure showing tubes extending through the stiffener plate.
Figure 6:
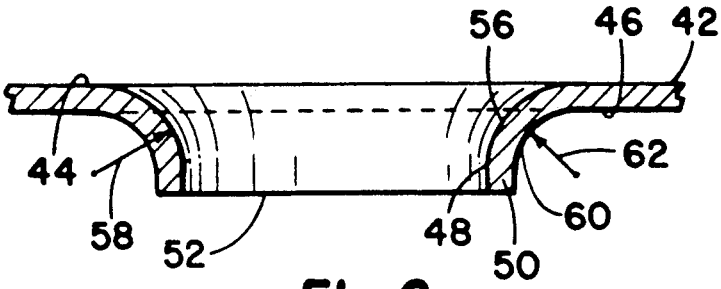
FIG. 6 is an enlarged fragmentary view of the stiffener plate as taken along the line 6—6 of FIG. 4 showing one opening through the stiffener plate with the integral ferrule portion as employed to receive one heat exchanger tube therethrough.

Thus, the prior art illustrated in FIGS. 7, 8, and 9 has disadvantages which are overcome by the stiffener plate of this invention, as illustrated best in FIGS. 5 and 6.

Figure 2:
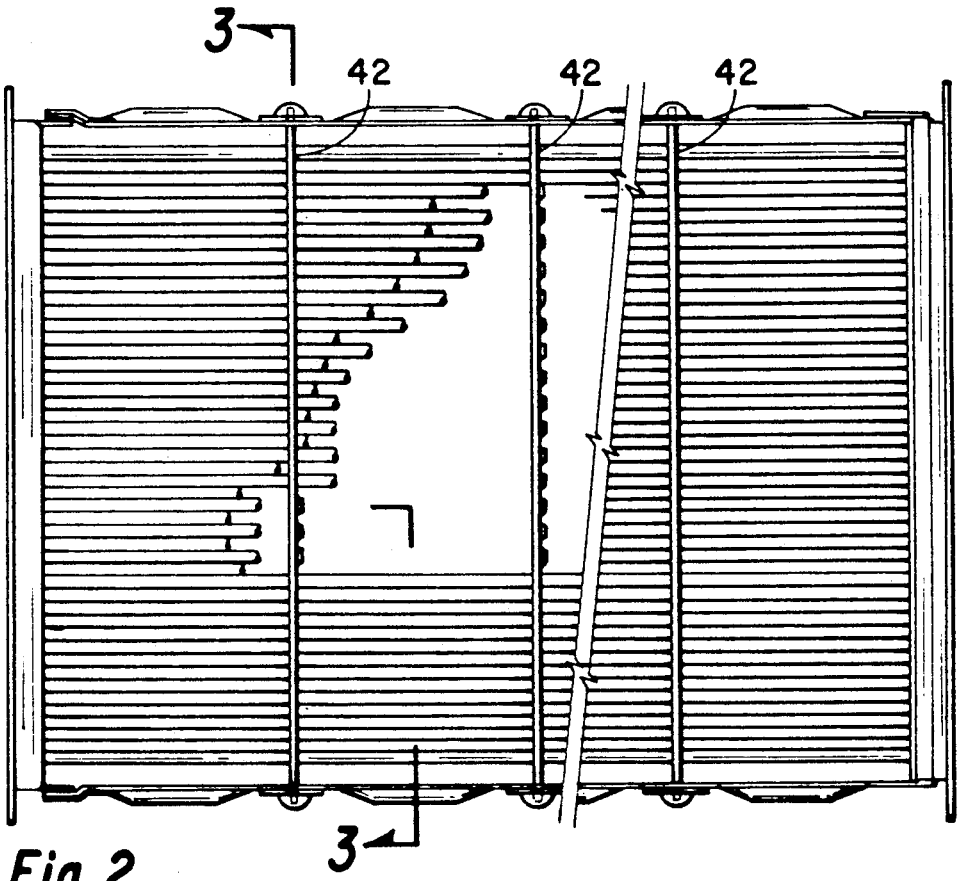
FIG. 2 is an elevational view of a core from an aircraft heat exchanger of the type illustrated in FIG. 1 showing multiple tubes and the type of stiffener plate of this disclosure used therewith.
Figure 3:
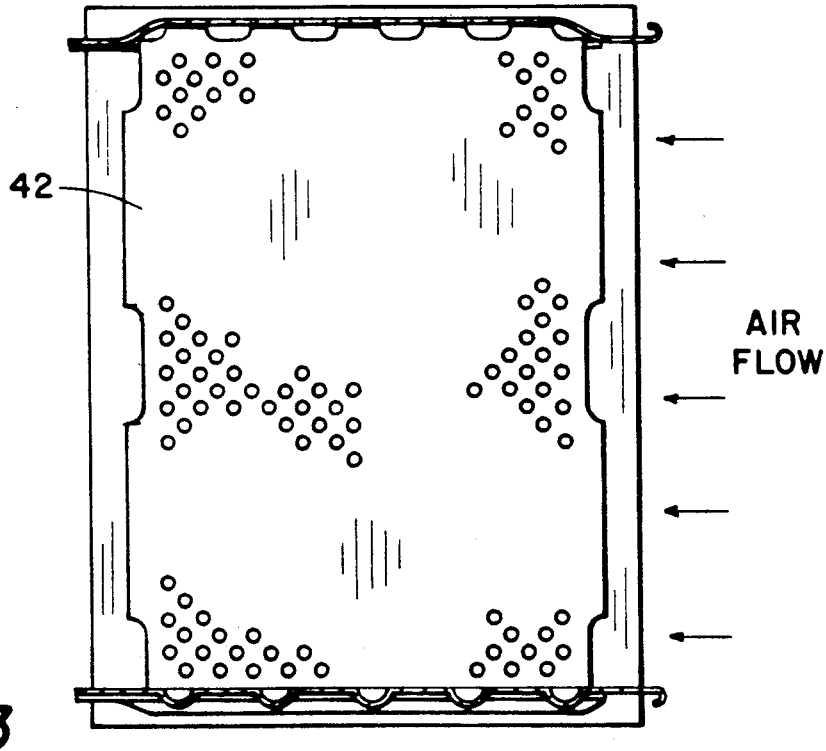
FIG. 3 is a cross-sectional view taken along the line 3—3 of FIG. 2 showing an elevational view of a stiffener plate of this disclosure as positioned within the heat exchanger core member.
Figure 4:
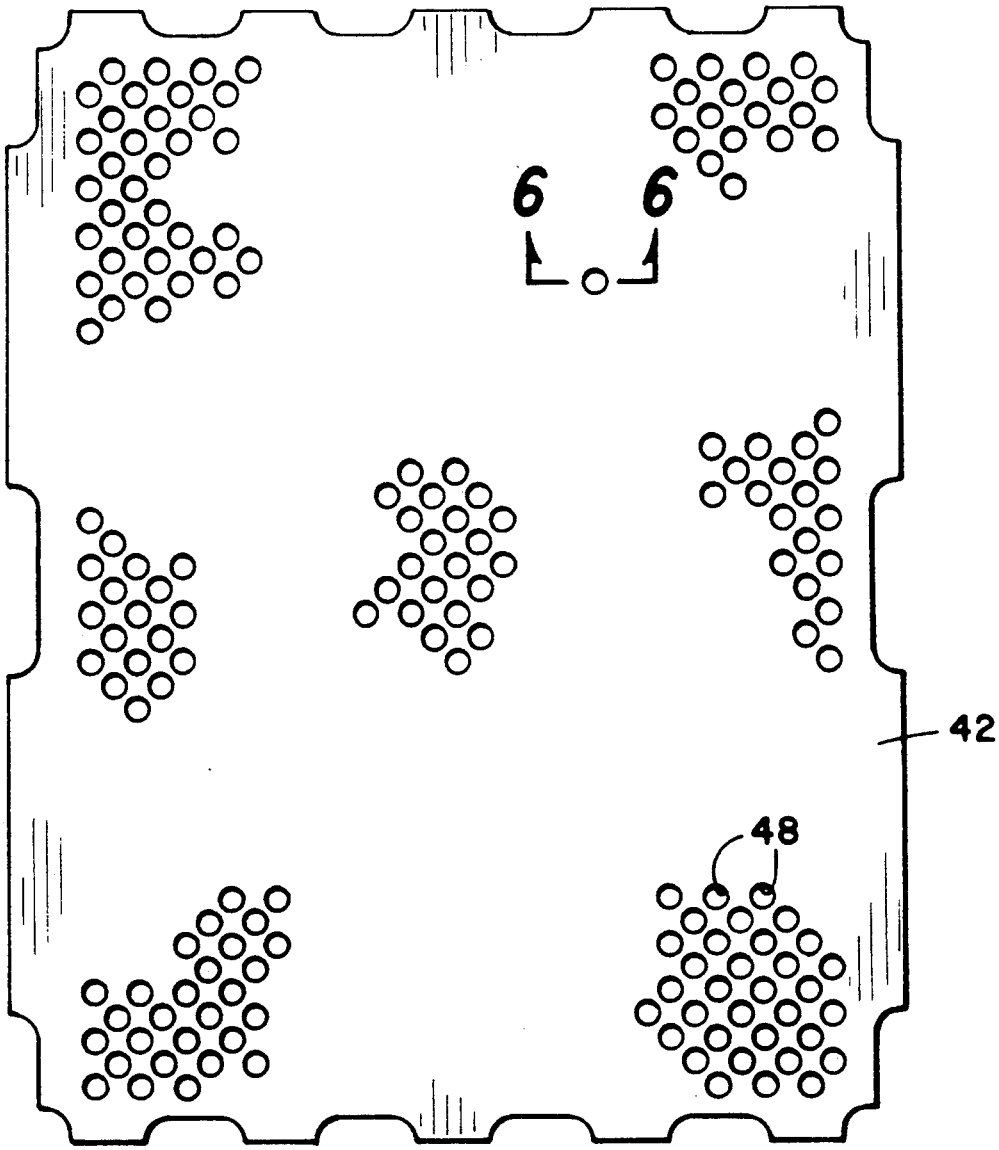
FIG. 4 is an enlarged elevational view of the stiffener plate of FIG. 3.

Turning now to FIGS. 2–6, the improved stiffener plate of this invention is disclosed. FIG. 2 shows the use of three stiffener plates 42 of the type of this invention. FIG. 3 shows, in elevational view, one side of one of the stiffener plates 42, and FIG. 4 shows a stiffener plate alone before it is used to become a part of a heat exchanger core assembly.

The stiffener plate 42 is a unitary relatively thin planar metallic plate having a first surface 44 and a second opposed surface 46. There is provided an opening 48 for each of the tubes 14 making up the core of a heat exchanger.

The unique feature of the stiffener plate of this invention is best seen in FIGS. 5 and 6, and particularly in FIG. 6 which is an enlarged view of one opening 48 in plate 42. The opening 48 is configured to provide an integral short-length tubular ferrule portion 50 for each opening 48 in stiffener plate 42. The integral ferrule portion has an end surface 52 that is in a plane parallel to and spaced from the stiffener plate second surface 46.

The opening 48 through plate 42 and the integral ferrule portion 50 is formed by an inner surface formed in part by an arcuate portion 56 at a selected first radius formed in the plate second surface 46. The arcuate portion 50A of the integral tubular ferrule portion 50 is further formed in part by an arcuate surface 60 at a radius 62 that is smaller than the first radius 58. The inner arcuate surface 56 is a continuation of the stiffener plate first surface 44 and the outer arcuate surface 60 is a continuation of the plate second surface 46.

FIG. 5 shows a small portion of stiffener plate 42 of this disclosure with fragmentary lengths of heat exchanger tubing 14 extending through openings 48.

The integral ferrule employed for each opening in stiffener plate 42 has advantages over the prior art devices as represented by FIGS. 7, 8 and 9. First, the integral ferrule, as best seen in FIG. 6, provides an opening in which the stress transferred between the heat exchanger tube and the stiffener plate is not concentrated as in the arrangement of FIG. 7 but, instead, a short-length tubular portion 50B of the plates receives each of the tubes so that contact between the plate and the tubes is spread over a length of the tube rather than concentrated only in an area equal to the thickness of the plate, as is illustrated in FIG. 7. Further, the integral ferrule cannot become disengaged from plate 42 as can occur in the prior art embodiment of FIG. 8. The integral ferrule of this disclosure eliminates the requirement of brazing of a tubular ferrule for each opening through the plate, as in the embodiment of FIG. 9, resulting in substantial cost saving.

Thus, the stiffener plate of this disclosure with the integral ferrules has substantial advantages over the known prior art.

It should be emphasized that the illustration of the prior art in FIGS. 7, 8 and 9 is not intended to be exhaustive but merely illustrative of commonly employed stiffener plates to which the present invention is directed as an improvement.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. For use in a heat exchanger having a plurality of tubes, a stiffener plate for supporting the tubes comprising:

a unitary relatively thin planar metal plate of selected thickness, the plate having an opening therethrough for each tube to be supported, each opening being in the form of an integral ferrule portion of internal diameter dimensioned to receive a tube therethrough, each integral ferrule portion having an integral arcuate portion and an integral short length tubular portion terminating in an end surface in a plane paralleled to and spaced from said plate said integral arcuate portion and said integral tubular portion of each said integral ferrule portion being of substantially the same thickness as said plate.

2. For use in a heat exchanger having a plurality of tubes, a stiffener plate for supporting the tubes comprising:

a unitary relatively thin planar metal plate of selected thickness, the plate having a first side and a second side and an opening therethrough for each tube to be supported, each opening being in the form of an integral ferrule portion of internal diameter dimensioned to receive a tube therethrough, each ferrule portion having an integral arcuate portion having an inner surface defined in part by a first radius and an outer surface defined by a second radius smaller than said first radius, and each ferrule portion having an integral short length tubular portion terminating in an end surface in a plane paralleled to and spaced from said plate second surface, each said integral arcuate portion and each said integral tubular portion of each said integral ferrule portion being of substantially the same thickness as said plate.

3. An assembly for use in a heat exchanger comprising:

a plurality of cylindrical, spaced apart, paralleled tubes arranged for the flow of fluid therethrough; and means for supporting said plurality of cylindrical, spaced apart, paralleled tubes comprising at least one unitary relatively thin planar metal plate of selected thickness, the plate having a plurality of openings therein each receiving a said tube therethrough, each opening being formed by an integral arcuate portion and an integral short length tubular portion dimensioned to and slideably receiving a said tube therethrough, each integral tubular portion terminating in an end surface in a plane paralleled to and spaced from said plate, said integral arcuate portion and said integral tubular portion of each said openings being of substantially the same thickness as said plate.

4. An assembly for use in a heat exchanger comprising:

a plurality of cylindrical, spaced apart, paralleled tubes arranged for the flow of fluid therethrough; and means for supporting said plurality of cylindrical spaced apart tubes comprising at least one unitary relatively thin planar metal stiffener plate of selected thickness, the plate having a first side and a second side and having a plurality of openings therein each receiving a said tube therethrough, each opening being in the form of an integral ferrule portion of internal diameter dimensioned to and receiving a said tube therethrough, each ferrule portion having an integral arcuate portion having an inner surface defined in part by a first radius and an outer surface defined by a second radius smaller than said first radius and each ferrule portion having an integral tubular portion terminating in an end surface in a plane paralleled to and spaced from said plate second surface, said integral arcuate portion and said integral tubular portion of each said integral ferrule portion being of substantially the same thickness as said plate.

* * * * *